United States Patent [19]

Kozai

[11] 3,961,685

[45] June 8, 1976

[54] LADDER WORKING LIMIT BASED LADDER STOPPING DEVICE FOR AERIAL LADDER TRUCK

[75] Inventor: Tetsuo Kozai, Osaka, Japan

[73] Assignee: Morita Pump Kabushiki Kaisha, Osaka, Japan

[22] Filed: Dec. 23, 1974

[21] Appl. No.: 536,036

[52] U.S. Cl. ..... 182/19; 212/39 A; 214/764; 182/2

[51] Int. Cl.[2] ..... B66F 11/04

[58] Field of Search ..... 82/2, 19, 18, 141; 212/39 R, 39 A; 340/282; 214/761, 764

[56] References Cited

UNITED STATES PATENTS

| | | | |
|---|---|---|---|
| 2,772,411 | 11/1956 | Cooper | 212/39 R |
| 3,122,125 | 2/1964 | Towne | 212/39 A |
| 3,223,249 | 12/1965 | Cady | 212/39 R |
| 3,566,386 | 2/1971 | Hamilton | 212/39 A |
| 3,680,714 | 8/1972 | Holmes | 212/39 A |
| 3,740,534 | 6/1973 | Kezer | 212/39 A |

*Primary Examiner*—Reinaldo P. Machado
*Attorney, Agent, or Firm*—Hall & Houghton

[57] ABSTRACT

There is provided a ladder working limit based ladder stopping device for a vehicle equipped with a vertically and horizontally swingable and extensible ladder (or a fire engine truck), wherein a working limit of the ladder is preset on the basis of an extended length of the ladder corresponding to a particular vertical angle assumed by the ladder, so that when the combined situation of the vertical angle and extended length of the ladder reaches said preset condition, the operating mechanism for the ladder is automatically returned to its neutral position while actuating a warning device and turning on a marker lamp, the operating mechanism being then operated toward the safety side, whereupon the marker lamp is turned off to indicate that the ladder is now safe.

4 Claims, 8 Drawing Figures

LADDER WORKING LIMIT BASED LADDER STOPPING DEVICE FOR AERIAL LADDER TRUCK

BACKGROUND OF THE INVENTION

1. Field of the Invention

The present invention relates to a ladder working limit based ladder stopping device for vehicle equipped with a vertically and horizontally swingable and extensible ladder (or a fire engine truck).

2. Description of the Prior Art

In an aerial ladder truck of the type described, the vertical swing and extension of the ladder are carried out by oil pressure. Thus, a ladder vertical angle indicator and a ladder extension indicator are separately attached to the truck. The operator of the ladder carries out the operation of the ladder while watching said two indicators in such a manner that when he finds that the ladder approaches a dangerous condition, he stops the operation and then handles the ladder so as to avoid the danger. In order to determine whether the ladder is in a dangerous condition or not, he reads the indicated values on said two indicators and checks them with a conversion table or the like to find the bending moment acting around the pivoted point on the ladder. With such procedure, however, there is a disadvantage that it is impossible to take a quick and proper measure. Another disadvantage is that whether the ladder has got out of the danger or not cannot be immediately ascertained.

SUMMARY OF THE INVENTION

The present invention has been accomplished to eliminate the above-mentioned disadvantages of the prior art aerial ladder truck and comprises a vertical angle indicator, an extension indicator and a bending moment load indicator which are collected in a single indicating section so that the conditions of the ladder can be grasped at a glance, the arrangement being such that when the ladder approaches a dangerous condition, the operation of the ladder is automatically stopped and the automatic stopping device is then manually operated toward the safety side to remove the danger, whereupon it can be easily ascertained that the ladder has really got out of the danger.

DESCRIPTION OF THE PREFERRED EMBODIMENT

Figure 1:
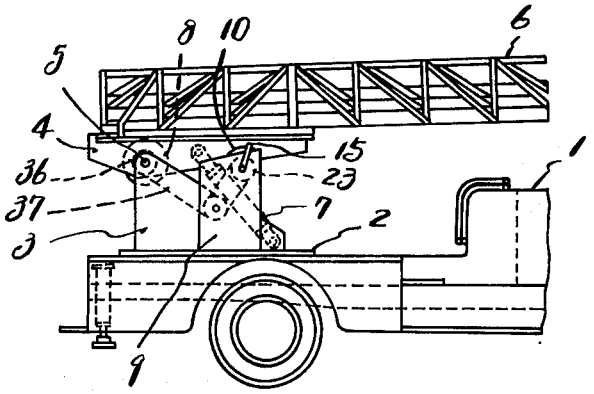
FIG. 1 is a schematic side view of the principal portions of an aerial ladder truck according to the present invention.

In FIG. 1, the character 1 designates an aerial ladder truck; 2, a turntable mounted on the rear portion of the truck; 3, a ladder support pillar erected on the turntable; 4, a ladder support frame pivotally mounted on the ladder support frame; and the character 6 designates a ladder supported on the ladder support frame.

The ladder 6 is adapted to be vertically swung by a hydraulic cylinder 7 interposed between the ladder support pillar 3 and the ladder support frame 4. Further, the ladder 6 is extended and contracted by a rope winding drum 8 coaxially mounted on the pivot 5. Thus, the rope (not shown) passes around the ladder in zigzags in such a manner that when the rope is wound around the drum 8, the ladder is extended and that when the rope is unwound, the ladder is contracted. The drum 8 is connected to a hydraulic motor. The rotation or horizontal swing of the ladder is effected by rotating the turntable 2. The turntable is driven by a hydraulic motor. These two hydraulic motors and the hydraulic cylinder 7 for vertical swing of the ladder are connected to a single hydraulic pump through separated pipes each having a manually operated valve placed in an intermediate portion thereof.

The hydraulic pump is mounted on the aerial ladder truck and driven by the truck engine or by a separate engine. The hydraulic pump is provided with means whereby the r.p.m. and the rate of discharge are controlled.

The manually operated valves are collectively installed on a control tower 9 on the turntable 2 and each valve has an operating lever.

The construction described above is substantantially the same as a conventional aerial ladder truck.

The amount of extension and the vertical angle of the ladder are indicated on the control tower 9 by an arrangement to be presently described.

Figure 3:
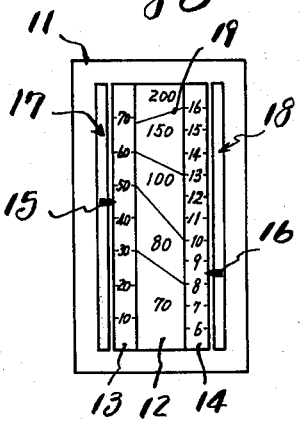
FIG. 3 is a plan view of the gauge case.
Figure 2:
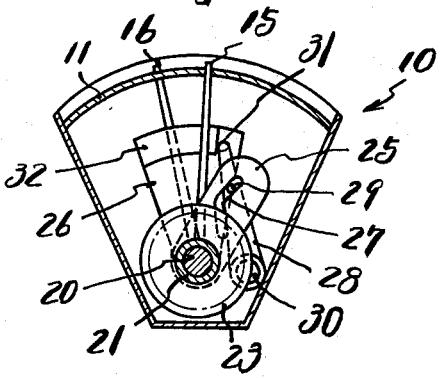
FIG. 2 is a front view, in longitudinal section, of a gauge case.

A gauge case 10 as shown in FIG. 2 is mounted on the control tower 9. An arcuate plate 11 is attached to the upper surface of the gauge case. As shown in FIG. 3, the plate is marked with a load scale 12 and with a vertical angle scale 13 and an extension scale 14 on either side of said scale 12. An angle pointer 15 associated with the vertical angle scale 13 and an extension pointer 16 associated with the extension scale 14 project through elongated openings 17 and 18, respectively, in the plate 11.

The angle scale 13 and extension scale 14 on the plate 11 are interconnected by limit load lines 19. The limit loads are determined by allowing for a safety factor to some extent. In determining such limit load, the limit of extension of the ladder is calculated when the angle is fixed. This will be explained by referring to FIG. 3. Thus, when the angle is 30°, the allowable extension is 8 m, beyond which danger exists. Similarly, for an angle of 50°, the extension limit is 10 m; for 60°, it is 13 m; and for 70°, it is 16 m. The limit loads for an aerial ladder truck are entirely different from those for a crane and determined on the basis of bending moment loads. Thus, as the ladder is extended, the bending moment increases. Further, the smaller the vertical angle, the greater the bending moment. Therefore, it follows that if the vertical angle decreases, this is dangerous unless the amount of extension of the ladder is decreased.

Figure 5:
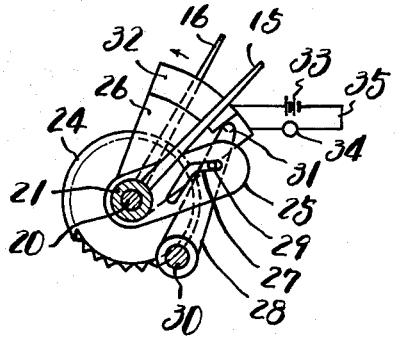
FIG. 5 is a front view of said indicating mechanism.
Figure 4:
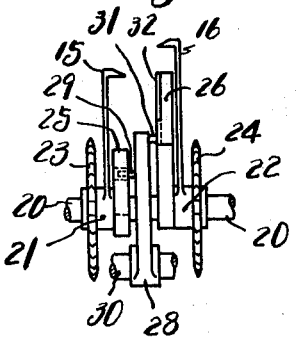
FIG. 4 is a side view of an indicating mechanism inside the gauge case.

The angle pointer 15 and extension pointer 16 are rigidly secured to sleeves 21 and 22, respectively, loosely fitted over a fixed shaft 20, as shown in FIG. 4. The sleeves 21 and 22 have chain wheels 23 and 24 secured to their outer ends and an angle cam plate 25 and extension plate 26 secured to their inner ends, respectively. The angle cam plate 25 is formed with a cam groove 27, as shown in FIG. 5. A pin 29 on a movable arm 28 extends through said cam groove 27. The movable arm 28 is loosely fitted over a shaft 30 which is parallel to the fixed shaft 20. The movable arm is disposed intermediate between said angle cam plate 25 and said extension plate 26 and has said pin 29 on one surface thereof and a contact 31 on the other. The pin 29 is inserted in the cam groove 27 in the angle cam plate 25, as described above. The contact 31 is adapted to contact an electrically conductive plate 32 provided on the inner surface of the extension plate 26. The contact 31 and electrically conductive plate 32, as schematically shown in FIG. 5, have connected thereto the terminals of an electric circuit 35 including a power source 33 and a lamp 34. The contact 31 and electrically conductive plate 32 constitutes a switch for said electric circuit 35.

In FIG. 2, it is so arranged that as the two pointers 15 and 16 move from right to left, the indicated values increase. If, therefore, the indicated value by the angle pointer 15 is large and the indicated value by the extension pointer 16 is small, the electrically conductive plate 32 and the contact 32 are separated from each other, so that the lamp 34 is not turned on. The lighting of the lamp 34 indicates the working limit of the ladder 6. Therefore, the lamp may be replaced by other warning device such as buzzer.

Figure 6:
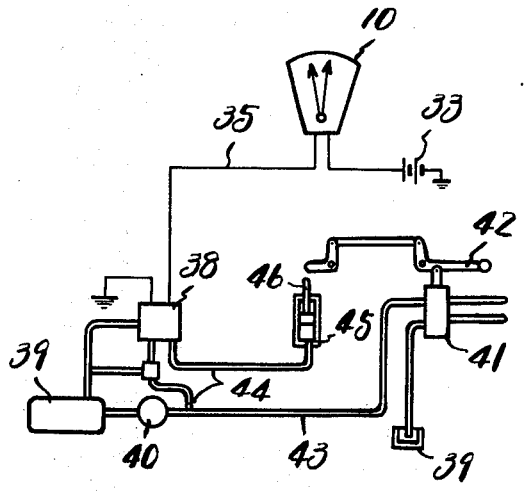
FIG. 6 is a schematic view of an automatic stopping device.

The two pointers 15 and 16 are moved along the elongated openings 17 and 18 by the rotation of the chain wheels 23 and 24 to indicate the vertical angle and amount of extension of the ladder. Thus, the vertical angle is converted into the rotation of a chain wheel 36 fixed on the ladder support frame 4, said rotation being transmitted to the chain wheel 23 through a chain 37, while the amount of extension of the ladder is converted into the rotation of the ladder extension and contraction rope winding drum 8 journaled in the support frame 4 of the ladder 6, said rotation being transmitted to the chain wheel 24, (see FIG. 1). When the chain wheel 23 is rotated, the angle cam plate 25 integral therewith is moved. As a result, the movable arm 28 is rotated clockwise or counterclockwise by the action of the cam groove 27. In the condition shown in FIG. 2, if the extension pointer 16 approaches the angle pointer 15, the contact 31 contacts the electrically conductive plate 32. This means that the two pointers 15 and 16 indicate one of the limit load lines 19 drawn obliquely on the load scale 12. As a result, the circuit 35 of the lamp 34 is closed to turn on the lamp 34. If the lamp is replaced by a buzzer, the buzzer is rung to tell that the working limit of the ladder is reached. In addition, the angle cam plate 25, extension plate 26 and movable arm 28 are made of an insulating material. As shown in FIG. 6, a solenoid valve 38 is placed in series in the electric circuit 35 which has been described above with reference to FIG. 5. In FIG. 6, the character 39 designates an oil tank; 40, an oil pump; 38, a manual valve for extension and contraction of the ladder; and the character 42 designates an operating lever for said valve. The oil tank 39 and oil pump 40 are mounted on the aerial ladder truck (not shown). The manual valve 41 and operating lever 42 are provided in the control tower 9. Working oil is fed into the manual valve 41 from the oil pump 40. Such oil is fed into a hydraulic motor (not shown) for the ladder extension and contraction rope winding drum 8 shown in FIG. 1. The solenoid valve 38 is placed in an oil pipe 44 branching off from an oil pipe 43 through which working oil from the oil pump is conveyed to the manual valve 41. The branch oil pipe 44 is connected to a hydraulic cylinder 45 for returning the operating lever 42 to its neutral position. The hydraulic cylinder 45 has a piston rod 46 opposed to the operating lever 42. The operating lever has two more positions, namely, an extension position and a contraction position on both sides of the neutral position. When the solenoid valve 38 is energized, the hydraulic cylinder 45 receives working oil from the oil pump 40 through the oil pipe 44 so that the piston rod 44 is projected. When the solenoid valve 38 is not energized, the supply of oil from the oil pump 40 is interrupted and the cylinder oil chamber communicates with the oil tank 39 to allow the free movement of the piston. The relation between the hydraulic cylinder 45 and the operating lever 42 is such that when the operating lever is on the extension side, the solenoid valve 38 is energized to project the piston rod 46, thereby pushing the operating lever 42 to its neutral position. In other cases, for example, when the operating lever is in its neutral position or in its contraction position, the projection of the piston rod 46 has no influence on the operating lever 42. In addition, when the solenoid valve 38 is energized with the piston rod 46 projected by the working oil from the pump 40, it becomes impossible to move the operating lever to the extension position. In this condition, the operating lever is still free to be moved to its contrction position. That is, it is when the working limit of the ladder 6 is reached that the solenoid valve 38 is energized. At such time, the extending operation of the ladder is automatically stopped. Thus, the contracting operation of the ladder is made possible.

The same arrangement as that shown in FIG. 6 is employed in the operating valve for the hydraulic cylinder for vertical swing of the ladder, though such construction is not shown. In the case of vertical swing, however, it has a raising position and a lowering position on both sides of its neutral position. It is so arranged that the operation toward the lowering side is made impossible by the piston rod of the cylinder and that when the working limit of the ladder 6 is reached during lowering operation, the lowering operation is automatically stopped. In this case also, a solenoid valve for automatically stopping raising and lowering operation is used.

Figure 7:
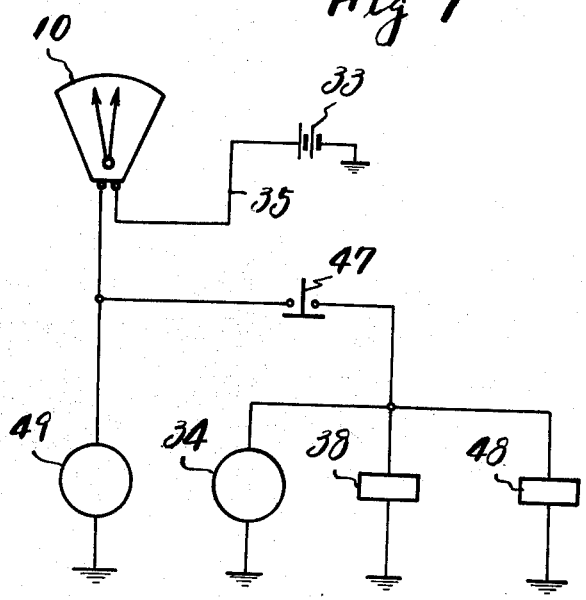
FIG. 7 is an electric circuit diagram for said device.

The solenoid valve for automatically stopping raising and lowering operation and solenoid valve for automatically stopping extension and contraction are connected in an electric circuit such as shown in FIG. 7. In FIG. 7, the character 10 designates a gauge case; 33, a power source; 34, a warning device; 47, a manual switch for removing working limit condition; 38, a solenoid valve for automatically stopping extension and contraction; 48, a solenoid valve for automatically stopping raising and lowering operation; and the character 49 designates a marker lamp. The marker lamp 49 will remain turned on so far as the switch mechanism in the gauge case 10 is not opened, even if the manual switch 47 is opened.

The manual switch 47 is installed on the control tower 9 and normally closed. During the operation of the ladder, if the switch mechanism in the gauge case 10 is closed, the working limit is reached. That is, an electric current flows through the warning device 34, solenoid valves 38 and 48 and marker lamp 49. When this condition is established, the operating lever of the ladder 6 is automatically returned to its neutral position. Therefore, the operation of the ladder 6 is stopped at the working limit. Moreover, the operation toward the danger-increasing side is made impossible. However, the operation toward the safety side is possible.

Figure 8:
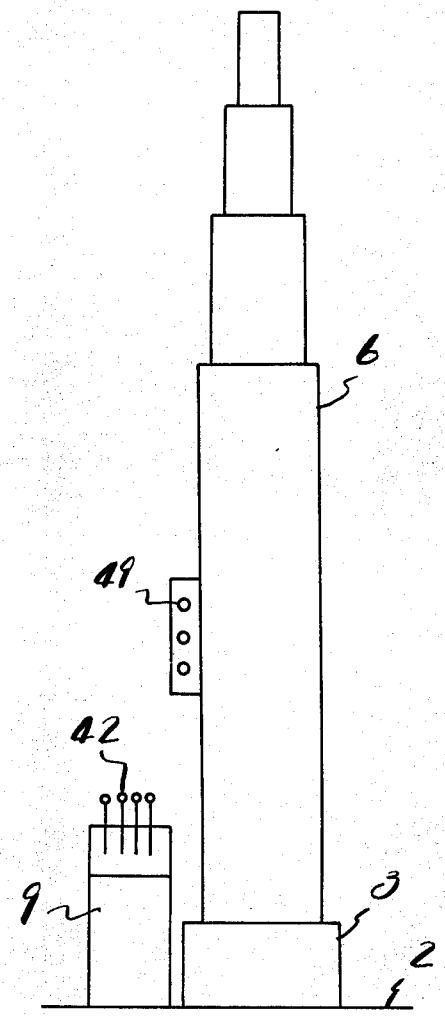
FIG. 8 is a schematic view of the base portion of a ladder showing an example of a marker lamp fixing position.

Further, when the ladder is operated away from the working limit toward the safety side, this can be ascertained since the marker lamp 49 is turned off. The marker lamp may be installed on the control tower 9 or on the base portion of the ladder 6 as shown in FIG. 8. The operation of the ladder is carried out at the position of the control tower 9. Since the operator often operates the ladder 6 while watching the ladder, it appears that the best position for mounting of the marker lamp 49 is at the base portion of the ladder as shown in FIG. 8.

Whiles there have been described herein what are at present considered preferred embodiments of the several features of the invention, it will be obvious to those skilled in the art that modifications and changes may be made without departing from the essence of the invention.

It is therefore to be understood that the exemplary embodiments thereof are illustrative and not restrictive of the invention, the scope of which is defined in the appended claims and that all modifications that come within the meaning and range of equivalency of the claims are intended to be included therein.

What is claimed is:

1. In an aerial ladder truck assembly having a turntable unit mounted on the rear portion of the truck, a ladder support pillar unit mounted on the turntable unit, a ladder support frame unit pivotally mounted on the ladder support pillar unit, ladder means mounted on the ladder support frame unit, hydraulic cylinder means operatively positioned between the ladder support pillar unit and the ladder support frame unit to vertically swing the ladder means, operating lever means for actuating said hydraulic cylinder means, drum means to extend and contract the ladder means, hydraulic driving means for actuating the drum means, operating lever means for actuating said hydraulic driving means, hydraulic pump means for actuating the hydraulic cylinder means and the hydraulic driving means, and control means for operating said hydraulic cylinder means and said hydraulic driving means respectively, the improvement of a safety mechanism for preventing the vertical swinging and the extension of the ladder means beyond safe working limits, said safety mechanism including first indicator means operatively connected with the ladder means for indicating the amount of extension of the ladder means, second indicator means operatively connected with the ladder means for indicating the vertical swing of the ladder means, first solenoid valve means operatively associated with the hydraulic driving means for automatically stopping the extension and contraction of said ladder means, second solenoid valve means operatively associated with the hydraulic cylinder means for automatically stopping the raising and lowering of said ladder means, and electrical circuit means operatively connected to said first indicator means and to said second indicator means on the one side and to said first solenoid means and said second solenoid means on the other side, said electrical circuit means including switching means whereby when said ladder means reaches a maximum safe extension point at the particular vertical inclination angle of the ladder means as indicated by said first indicator means and said second indicator means, said switching means of said electrical circuit means will energize said first and second solenoid means to prevent any further movement of the ladder means beyond the safe point of the ladder means.

2. In an aerial ladder truck assembly in accordance with claim 1, wherein the electrical circuit means includes means giving a signal when the safe working limits of the ladder have been reached.

3. In an aerial ladder truck assembly in accordance with claim 1, wherein the first indicator means and the second indicator means are mounted in a single casing.

4. In an aerial ladder truck assembly means in accordance with claim 1, wherein said first indicator means and said second indicator means include a switch mechanism for energizing the electrical circuit means.

* * * * *